US006748882B2

(12) United States Patent
Martin et al.

(10) Patent No.: US 6,748,882 B2
(45) Date of Patent: Jun. 15, 2004

(54) PROCESS FOR INFLUENCING THE PROPERTIES OF INCINERATION RESIDUES FROM AN INCINERATION PLANT

(75) Inventors: Johannes Martin, München (DE); Oliver Gohlke, München (DE); Joachim Horn, Dietramszell (DE); Michael Busch, Rosenheim (DE)

(73) Assignees: Martin GmbH für Umwelt-und Energietechnik, Munich (DE); Mitsubishi Heavy Industries, Ltd., Chiyoda-Ku (JP)

( * ) Notice: Subject to any disclaimer, the term of this patent is extended or adjusted under 35 U.S.C. 154(b) by 0 days.

(21) Appl. No.: 10/400,722

(22) Filed: Mar. 27, 2003

(65) Prior Publication Data

US 2003/0183138 A1 Oct. 2, 2003

(30) Foreign Application Priority Data

Mar. 27, 2002 (DE) ..... 102 13 788

(51) Int. Cl.[7] ..... F23G 7/00; F23G 5/00

(52) U.S. Cl. ..... 110/346; 110/344; 110/165 R; 110/266

(58) Field of Search ..... 110/165 A, 165 R, 110/246, 266, 346, 235, 344; 210/195.1; 588/257; 432/16; 75/414, 500; 241/20; 423/210

(56) References Cited

U.S. PATENT DOCUMENTS

| | | | | | |
|---|---|---|---|---|---|
| 2,891,493 | A | * | 6/1959 | Gram, Jr. et al. | 110/266 |
| 3,745,941 | A | * | 7/1973 | Reilly | 110/346 |
| 4,932,336 | A | * | 6/1990 | Srowig et al. | 110/346 |
| 5,551,358 | A | * | 9/1996 | Burkhard et al. | 110/346 |
| 5,671,688 | A | * | 9/1997 | Burgin et al. | 110/344 |
| 5,950,548 | A | | 9/1999 | Martin et al. | 110/346 |
| 6,095,064 | A | * | 8/2000 | Millard et al. | 110/344 |
| 6,145,453 | A | * | 11/2000 | Martin et al. | 110/346 |
| 6,199,492 | B1 | * | 3/2001 | Kunstler | 110/342 |
| 6,309,338 | B1 | * | 10/2001 | Christensen | 588/257 |

FOREIGN PATENT DOCUMENTS

| | | | | |
|---|---|---|---|---|
| DE | 701606 | * | 1/1941 | |
| DE | 4429958 | * | 2/1996 | F23G/5/00 |

* cited by examiner

*Primary Examiner*—K. B. Rinehart
(74) *Attorney, Agent, or Firm*—Cohen, Pontani, Lieberman & Pavane

(57) ABSTRACT

In a process for influencing the properties of incineration residues from an incineration plant, in particular a waste incineration plant, the incineration is controlled sot that a sintering and/or fusing of the slag takes place as earl as in the incineration bed of the main incineration zone, and as yet unsintered or unfused incineration residues are separated off at the end of the incineration operation and fed back to the incineration operation.

11 Claims, 2 Drawing Sheets

PROCESS FOR INFLUENCING THE PROPERTIES OF INCINERATION RESIDUES FROM AN INCINERATION PLANT

BACKGROUND OF THE INVENTION

1. Field of the Invention

The invention relates to a process for influencing the properties of incineration residues from an incineration plant, in particular a waste incineration plant, in which the incineration material is incinerated on a furnace grate, and the incineration residues generated are brought to an elevated temperature by suitable incineration control.

2. Description of the Related Art.

In a process of this type, which is known from EP 0 667 490 B1, the incineration material from the furnace grate is heated to such an extent that the slag which is formed in the process is at a temperature which is just below the melting point of this slag before it reaches a melting stage arranged outside the furnace grate. In this process, therefore, the incineration is controlled in such a manner that at the end of the furnace grate the slag is at the highest possible temperature, in order to keep the energy required in the downstream melting stage as low as possible. However, this process does not involve any sintering or melting of the slag. In order nevertheless to obtain the desired slag quality, therefore, a downstream melting stage is required. This downstream melting stage not only requires a suitable device, but also, despite the procedure described above, an increased outlay on energy.

To achieve the desired quality of the slag, the inorganic and organic pollutants constituents which remain from the waste are of importance. Inorganic pollutant constituents which need to be mentioned are in particular heavy metals and salts, while the organic pollutants are attributable in particular to incomplete incineration. For assessment of the quality of the slag, it is also important how the pollutants which are present are washed out in elution tests. Moreover, mechanical properties are of importance in assessing the suitability for construction engineering purposes, e.g. in landfill sites, earthworks or road building.

On account of the high temperatures involved in treating the incineration residues in a melting stage, molten incineration residues are characterized by low levels of organic compounds. While typical slags from waste incineration plants still include unburnt material, usually measured as the loss on ignition, of from 1 to 5% by weight, the loss on ignition of fused incineration residues is less than 0.3% by weight. In addition, fused incineration residues are characterized by low levels of heavy metals and salts which can be leached out, since these are either evaporated or are incorporated in the vitreous matrix which forms when the molten material cools.

SUMMARY OF THE INVENTION

It is an object of the invention to influence and control the incineration operation in such a way that a fully sintered slag of the desired quality is obtained without using downstream melting or vitrification units.

The term "fully sintered slag" is understood as meaning a material which consists of sintered and/or fused lumps which typically have a grain size of at least 2 mm to 8 mm. These lumps consist of garbage incineration residues which have been agglomerated by complete or surface fusion.

On account of gases being released during sintering or fusion, the sintered or fused lumps may quite possibly have a porous structure. Any porosity in the fully sintered slag is attributable to the temperature of the molten slag in the incineration bed not being high enough to effect a sufficiently low viscosity and therefore to expel gas bubbles, a technique which in the glass industry is known as refining. In this respect, the fully sintered slag differs from typical vitrified slags which are obtained in downstream high-temperature processes carried out in crucible furnaces lined with refractory material or other melting units.

Moreover, the fully sintered slag may also contain constituents of waste, such as glass or metals, which pass through the furnace grate virtually unaffected by the incineration operation, i.e. in the narrow sense are neither fused nor sintered in the incineration bed, but do have the desired properties in terms of fitting and pollutants which can be leached out.

In accordance with Hämmerli (Müll und Abfall 31, Beiheft Entsorgung von Schlacken und sonstigen Reststoffen, [Disposal of slags and other residues supplement], page 142, 1994), the term "sintering" denotes a "specific case of fusion and freezing". In the text which follows, therefore, the term sintering goes beyond the use of this term as "superficial fusion of particles to one another or together" which is often customary in scientific fields. The sintered lumps of the fully sintered slag may quite possibly also be completely or partially melted.

In the text which follows, the term residual slag denotes slag constituents which are not sintered and/or fused. Residual slag is characterized by a smaller grain size than that of the fully sintered slag as well as a higher loss on ignition and a higher level of pollutants which can be leached out.

The object set above is achieved according to the invention, starting from a process explained in the introduction, by the fact that the incineration is controlled in such a way that sintering and/or fusing of the incineration residues to form slag takes place as early as in the incineration bed of the main incineration zone, and that as yet unsintered or unfused, or incompletely sintered or fused incineration residues are separated off at the end of the incineration operation and fed back to the incineration operation.

The basic idea of the invention therefore consists, firstly, in influencing the incineration operation on the furnace grate in such a way that a sintering and/or fusion operation takes place as early as on the furnace grate in the main incineration zone, and that in each case the as yet unsintered or unfused incineration residues are returned again, in order to undergo the desired sintering and/or fusion operation during the second or third pass.

Therefore, the focal point of the inventive idea consists in the sintering and/or fusion of the incineration residues being carried out as early as in the incineration bed of the main incineration zone, which has hitherto been considered impossible. This is because it is extremely damaging to mechanical furnace grates if liquid slag passes between the individual grate bars or other moveable parts of the furnace grate. For this reason, fusion of the slag on the grate has been avoided, and it has been ensured that the melting point of the slag is not reached in the incineration bed.

In the process according to the invention, the sintering and/or fusion operation takes place in the upper region of the incineration bed, since the maximum action of heat resulting from the radiation of the flame body is introduced from above, while at the bottom the temperature of the material lying directly on the furnace grate can be kept at a lower level, as a result of relatively cold primary incineration air being supplied, than the material at the top of the incineration bed. Since with combustion control of this nature not all the incineration residues produced can be converted into a fully sintered slag of the desired quality, those incineration residues which do not yet have the character of the fully sintered slag are fed back to the incineration operation.

Since the sintering and/or fusion of the slag is achieved in the incineration bed of the grate firing, no additional external energy source is required. The quality obtained as far as possible corresponds to that of the products which the person skilled in the art will recognize from the known downstream high-temperature thermal processes for fusion and vitrification. Equipment such as rotary tubular kilns, crucible furnaces and melting chambers are used. The main drawback of these known processes, however, is the need for the very expensive additional equipment and the high energy consumption, which is avoided by the present invention despite the fact that the quality of the slag remains approximately constant.

A significant advantageous aspect of the incineration control using the process according to the invention consists in the levels of oxygen in the primary incineration air being increased to approx. 25% by volume to 40% by volume. A further advantageous measure consists in the primary air temperature being preheated to levels of approx. 100° C. to 400° C. Depending on the particular conditions, these measures can be used separately or in combination with one another. It is preferable for the incineration bed temperature in the main incineration zone to be set at 1000° C. to 1400° C., depending on the particular condition of the material to be incinerated.

All the measures covered by the incineration control with a view to establishing the desired conditions, in which the incineration residues are converted into sintered and/or fused slag, are selected in such a way that the fully sintered slag forms a proportion of 25–75% by weight of the incineration residues as a whole. This measure ensures that there is sufficient unmelted material on the furnace grate in the incineration bed of the main incineration zone, surrounding the melting slag, so that the latter cannot have any adverse effect on the mechanical parts of the furnace grate.

In an advantageous further configuration of the invention, fly ash is fed back to the incineration operation. This fly ash leaves the incineration bed together with the incineration gases via the steam boiler and is separated out in a downstream off-gas filter.

The as yet incompletely sintered slag can be separated from the fully sintered slag by classification of the slag after it has been discharged from the incineration system by setting a separation cut-off at a grain size of, for example, 2 to 10 mm. In this case, the oversize fraction corresponds to the fully sintered slag, while the undersize fraction forms the fraction which is to be returned. Various mechanical separation methods which are known to the person skilled in the art are suitable for carrying out this process.

The separation can be carried out either by screening or, in a further advantageous configuration of the invention, by a combination of screening and a washing operation.

Of course, still further measures for improving the slag quality, which take place outside the incineration plant and in particular are envisaged to involve special washing processes with and without chemical additives, are also possible.

The fine fraction with a grain size of less than 2 to 10 mm is returned to the incineration operation. The return can be effected by admixing this material with the incineration material to be added or by adding it directly to the incineration bed. To avoid the formation of dust and to improve the handling properties, the fine fraction can be pelletized or briquetted before it is returned.

The invention is explained in more detail below with reference to two flow diagrams.

DETAILED DESCRIPTION OF THE PREFERRED EMBODIMENTS

Figure 1:
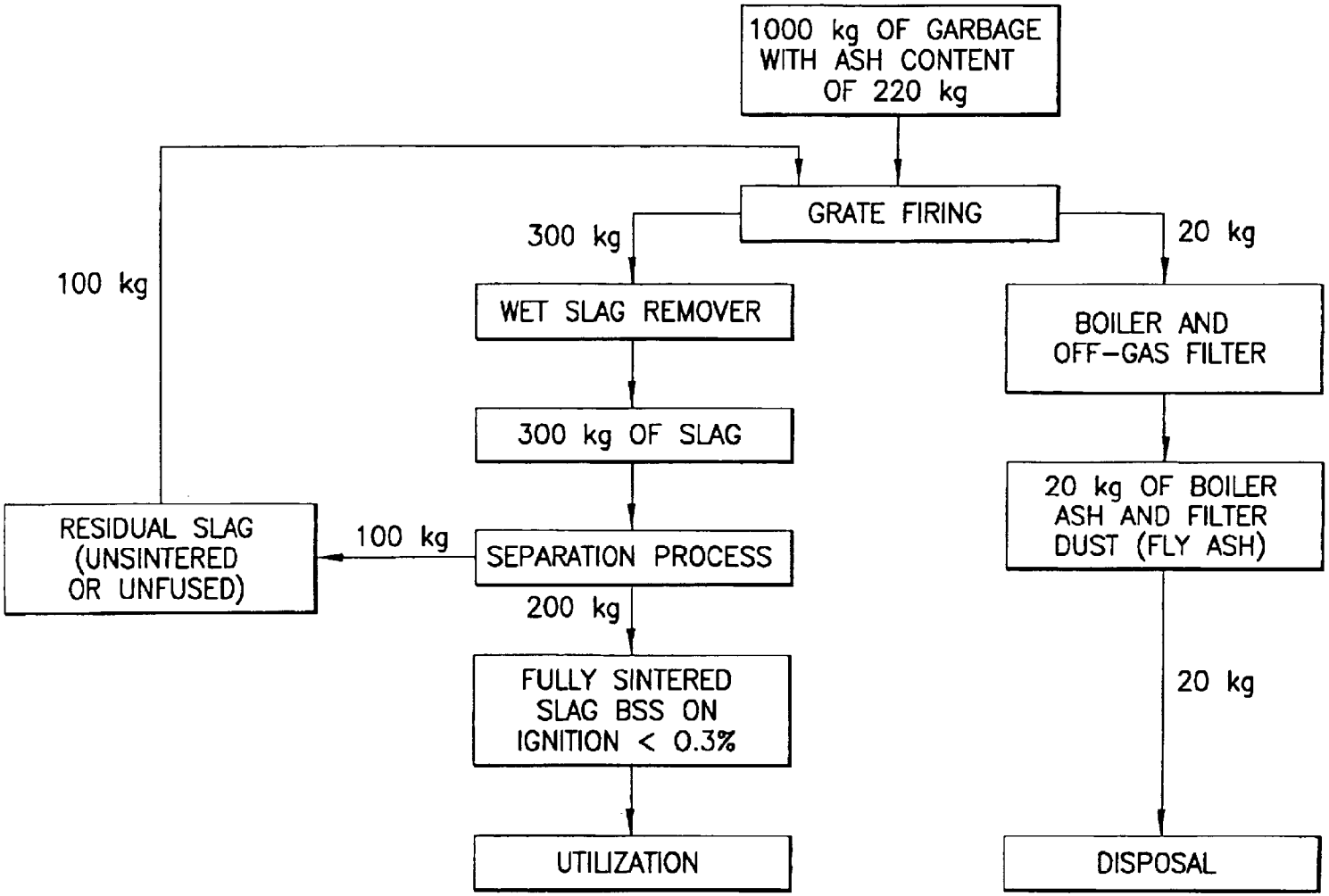
FIG. 1 is a flow diagram of a basic process.
Figure 2:
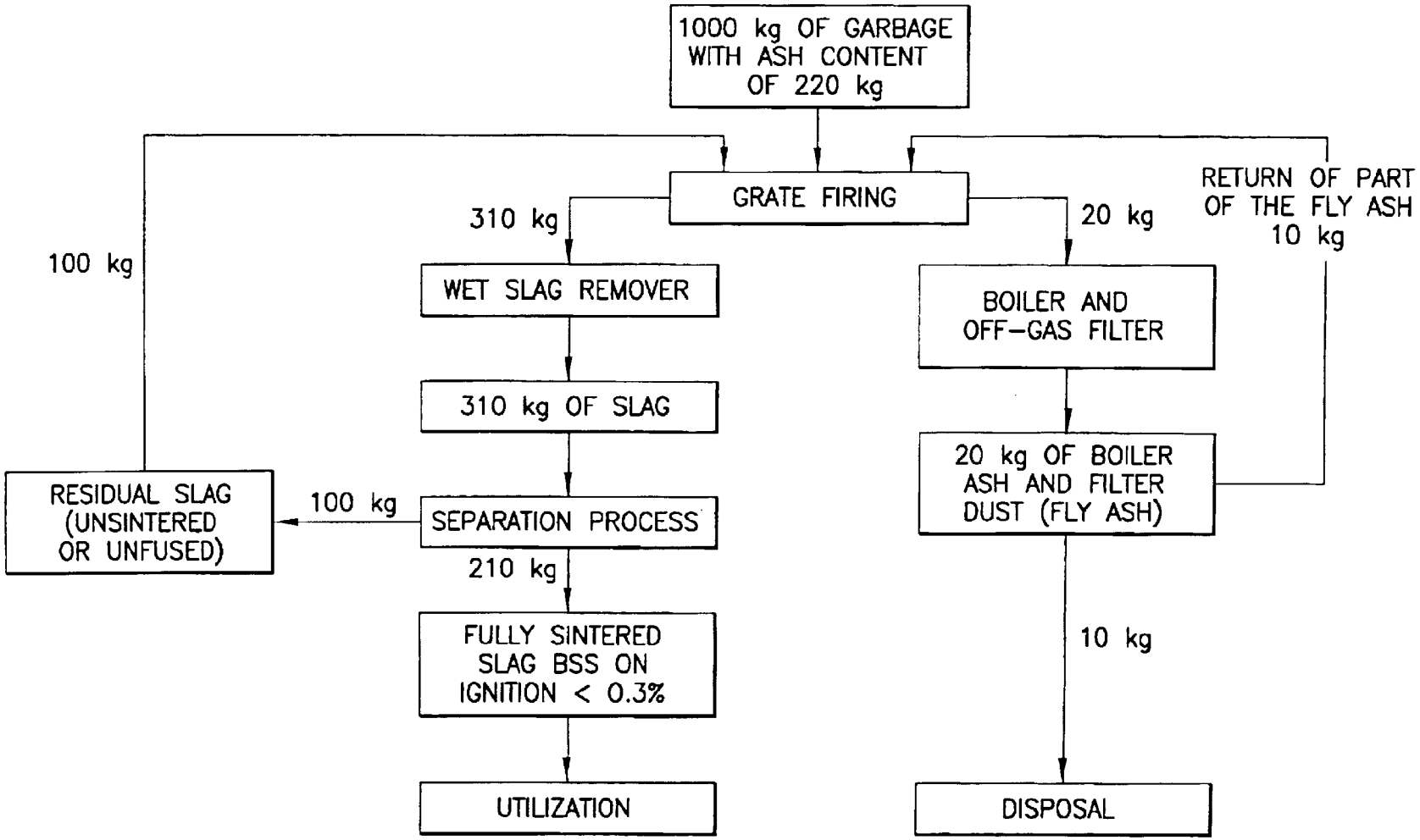
FIG. 2 is an extended embodiment of the process shown in FIG. 1.

In accordance with the two process variants shown in FIGS. 1 and 2, 1000 kg of garbage with an ash content of 220 kg are added to a grate firing and are incinerated in such a manner that even at this early stage from 25% to 75% of the incineration residues produced have been converted into fully sintered slag. The residues as a whole amount to 300 kg, which drop into a wet slag remover, are quenched therein and are discharged. 200 kg of fully sintered slag, which are fed for reuse, are separated off by means of a separation process which comprises a screening operation and if appropriate a washing operation. 100 kg of incineration residues which have not yet been sintered are fed back to the incineration operation. The fly ash which leaves the incineration chamber together with the flue gases amounts to 20 kg and is recovered in the off-gas filter and by cleaning the boiler pipes and is fed to a special disposal route.

In the variant shown in FIG. 2, 310 kg of incineration residues pass into a wet slag remover, since in this procedure 10 kg of the fly ash are fed back to the incineration operation. The rest of the process takes place in the same way as that shown in FIG. 1.

What is claimed is:

1. A process for sintering incineration residues from an incineration plant, said process comprising:

introducing incineration material into an incineration zone comprising an incineration bed on a furnace grate;

introducing primary incineration air to said incineration zone from below said furnace grate;

firing said incineration material in said incineration bed to effect incineration of said material to produce incineration residues and fly ash;

controlling said incineration to sinter said incineration residues to form slag in an upper region of said incineration bed in said incineration zone;

separating unsintered incineration materials from said slag when said incineration residues leave said incineration zone; and feeding said unsintered residues back to said incineration zone.

2. A process as in claim 1 wherein said incineration is controlled by maintaining 25% to 40% by volume of oxygen in said primary incineration air.

3. A process as in claim 1 wherein said incineration is controlled by preheating said primary incineration air to 100° C. to 1400° C.

4. A process as in claim 1 wherein said incineration is controlled by maintaining said incineration bed at a temperature of 1000° C. to 1400° C.

5. A process as in claim 1 wherein said incineration is controlled so that said incineration residues comprise 25% to 75% fully sintered slag.

6. A process as in claim 1 wherein said fly ash is fed back to said incineration zone.

7. A process as in claim 1 wherein fully sintered slag is separated from incompletely sintered slag.

8. A process as in claim 7 wherein the separation is carried out by screening out a grain size of 2 mm to 10 mm.

9. A process as in claim 1 wherein said unsintered residues are palletized or briquetted before being returned to said incineration zone.

10. A process as in claim 1 wherein said unsintered incineration residues are admixed with incineration material before feeding to said incineration zone.

11. A process as in claim 1 wherein said unsintered incineration residues are fed directly to said incineration zone.

* * * * *